United States Patent [19]

Krauss et al.

[11] 4,416,423

[45] Nov. 22, 1983

[54] ELECTROMAGNETICALLY ACTUATABLE VALVE, IN PARTICULAR A FUEL INJECTION VALVE FOR FUEL INJECTION SYSTEMS

[75] Inventors: Rudolf Krauss, Stuttgart; Udo Hafner, Lorch, both of Fed. Rep. of Germany

[73] Assignee: Robert Bosch GmbH, Stuttgart, Fed. Rep. of Germany

[21] Appl. No.: 307,241

[22] Filed: Sep. 30, 1981

[30] Foreign Application Priority Data

Dec. 12, 1980 [DE] Fed. Rep. of Germany ..... 3046889

[51] Int. Cl.[3] ..... F02M 51/00

[52] U.S. Cl. ..... 239/585

[58] Field of Search ..... 239/285, 125; 251/141

[56] References Cited

U.S. PATENT DOCUMENTS

| | | | |
|---|---|---|---|
| 2,130,666 | 9/1938 | Coffey | 239/585 X |
| 3,001,757 | 9/1961 | Ball | 239/585 |
| 3,587,970 | 6/1971 | Tindall et al. | 239/125 X |
| 4,033,507 | 7/1977 | Frömel | 239/585 X |
| 4,196,751 | 4/1980 | Fischer et al. | 251/141 X |
| 4,310,123 | 1/1982 | TePasste | 239/585 |
| 4,356,980 | 11/1982 | Krauss | 239/585 |
| 4,365,747 | 12/1982 | Knapp et al. | 239/585 X |

*Primary Examiner*—Andres Kashnikow
*Assistant Examiner*—Paul A. Sobel
*Attorney, Agent, or Firm*—Edwin E. Greigg

[57] ABSTRACT

An electromagnetically actuatable valve is proposed, which serves in particular to inject fuel into the intake tube of internal combustion engines operating with fuel injection systems. The fuel injection valve includes a valve housing, a shell-type core having a magnetic coil, and a flat armature. The flat armature is firmly connected with a spherical valve element which passes through a central guide opening in a guide diaphragm and cooperates with a fixed valve seat. The guide diaphragm guides the valve element in the radial direction toward the valve seat. The flat armature contacts the guide diaphragm via a concentric shoulder providing tension thereto so that the armature is guided in a plane parallel to the end face of the shell core. The fuel supply to the valve is effected via radial inlet openings in the valve wall. The non-metered fuel, after flowing through the magnetic element, can flow into a fuel return flow line by way of radial outlet openings which are axially offset and sealed from the inlet openings.

23 Claims, 2 Drawing Figures

ELECTROMAGNETICALLY ACTUATABLE VALVE, IN PARTICULAR A FUEL INJECTION VALVE FOR FUEL INJECTION SYSTEMS

BACKGROUND OF THE INVENTION

The invention is directed to improvements in electromagnetically actuated valves having a magnetic coil and an armature connected to a valve element guided by a diaphragm. An electromagnetically actuatable valve is already known in which the armature is positively connected to a guide diaphragm clamped to the housing on its outer circumference. However, this valve has the disadvantage that an additional work operation is required to connect the armature and the guide diaphragm, and as a consequence of this connection stresses are created in the guide diaphragm, causing the armature to incline at an angle relative to the core; the danger thus arises that the armature will not be attracted in a parallel direction. Furthermore, in order to be capable of generating the desired magnetic forces, the known embodiment of the magnetic element requires a relatively large space for its accommodation, and this hinders attempts to reduce the size of the valve as desired.

OBJECT AND SUMMARY OF THE INVENTION

It is an object of the invention to provide a valve having the advantage over the prior art that the flat armature is guided in a manner low in friction and in a parallel plane, while the magnetic element can be maintained small in size.

It is another object of the invention to provide a valve which avoids the additional work operation of armature/diaphragm connection as well as the possibility of oblique guidance of the armature which would result from stresses in the guide diaphragm.

It is still another object of the invention that the core comprise a shell core having inner and outer cores each cooperating with one functional area of the flat armature.

It is yet another object of the invention to provide the valve element with a spherical portion which cooperates with the valve seat.

A further object of the invention is provided by fabricating the valve housing in such a manner that no shavings result, such as by deep drawing, rolling, or the like.

Still a further object of the invention accrues from providing inlet and discharge openings in the valve housing wall which are radially offset from one another, so that unmetered fuel, after flowing around the magnetic element, can flow out again, carrying off heat as it does so.

Still another object of the invention is provided by a turbulent preparation of the fuel to be injected.

The invention will be better understood and further objects and advantages thereof will become more apparent from the ensuing detailed description of two preferred embodiments taken in conjunction with the drawings.

DESCRIPTION OF THE EXEMPLARY EMBODIMENTS

Figure 1:
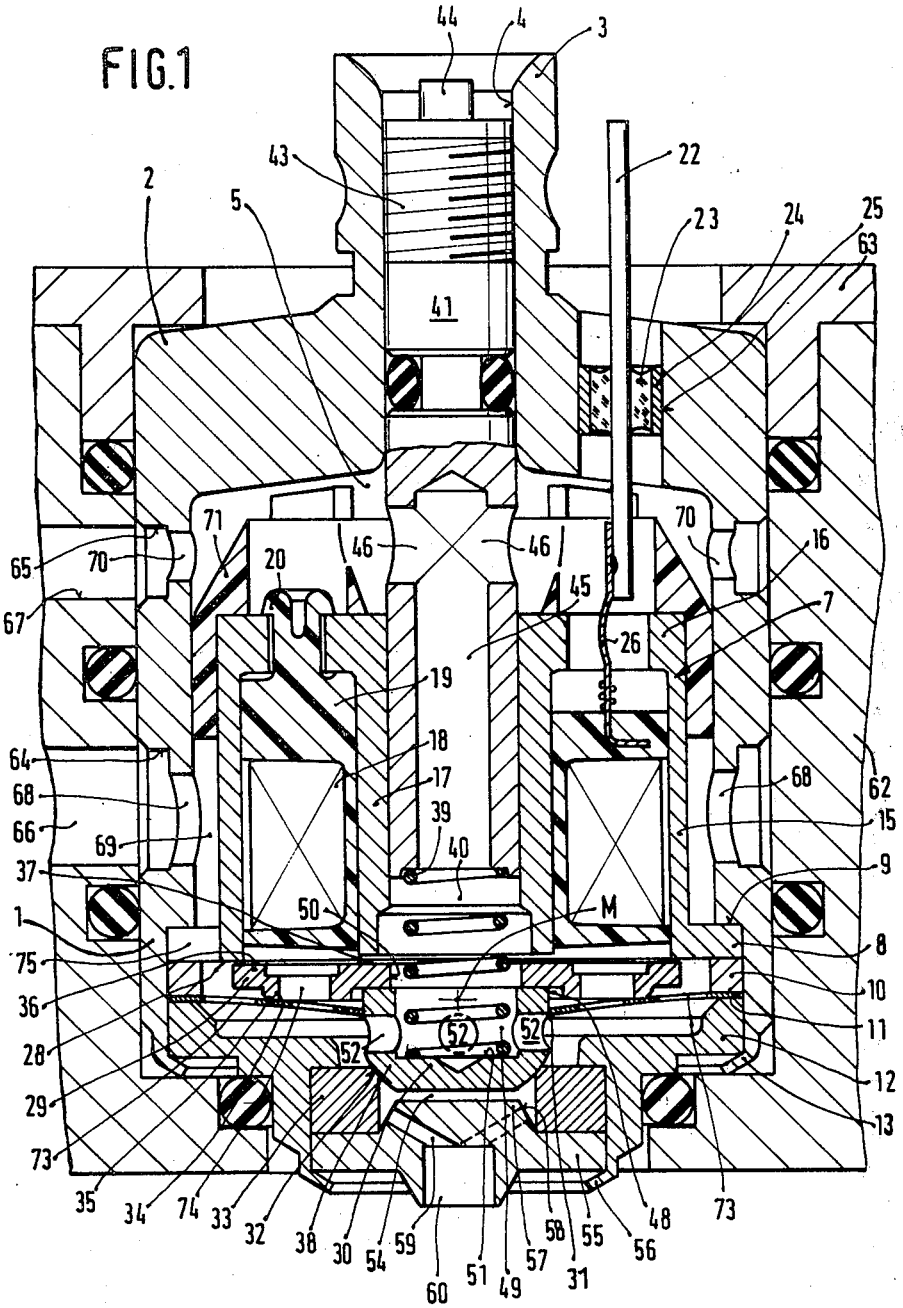
FIG. 1 is a sectional view of a first exemplary embodiment of an electromagnetically actuatable fuel injection valve.
Figure 2:
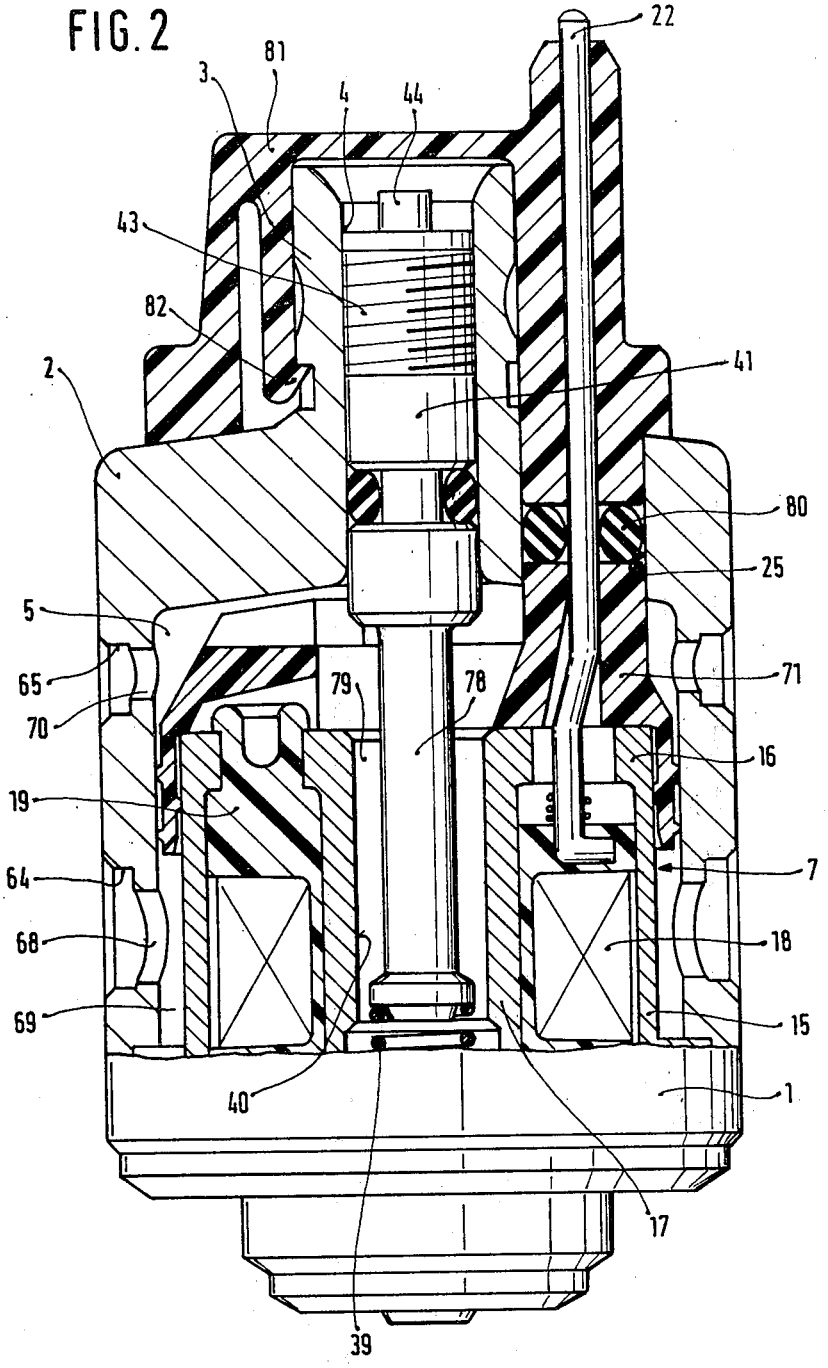
FIG. 2 is a sectional view of a second exemplary embodiment of an electromagnetically actuatable fuel injection valve.

The fuel injection valve shown in FIGS. 1 and 2, intended for a fuel injection system, serves by way of example to inject fuel, in particular at low pressure, into the intake tube of mixture-compressing internal combustion engines with externally supplied ignition. A valve housing 1 is fabricated by a non-cutting shaping method, such as deep drawing, rolling and the like; it is provided with a cup-shaped form with a bottom or base 2, from which a tubular guide fitting 3 is arranged to protrude in an upward direction. The guide fitting 3 includes a guide bore 4, which likewise passes through the base 2 and discharges into the interior of the valve housing 1. A shell core 7 of ferromagnetic material is inserted into the interior 5 of the valve housing 1. The shell core 7 has a smaller diameter than does the interior 5 and rests with a shoulder 8 on an inner step 9 of the valve housing 1. A spacer ring 10 engages the side of the shoulder 8 remote from the inner step 9. The spacer ring 10 is adjoined in sequence by a guide diaphragm 11 and then a nozzle carrier 12. The housing 1 is provided with a crimped edge 13 engaging the end face of the nozzle carrier 12 by partially surrounding it so as to exert an axial stress on the nozzle carrier. This axial stress assures the positional fixation of the shell core 7, the spacer ring 10, the guide diaphragm 11 and the nozzle carrier 12. A conventional shell-type core of type T 26 made by Siemens may be used as the shell core 7; this core is provided with an annular outer core 15 and an annular inner core 17 connected to the outer core via a crosspiece 16. A magnetic coil 18 is surrounded at least partially by an insulating carrier body 19, which is inserted together with the magnetic coil 18 into the annular chamber of the shell core 7 formed between the outer core 15 and the inner core 17 and is connected in a positively engaged manner with the crosspiece 16, for instance by means of rivets 20 or by a releasable snap-lock connection. The supply of electric current to the magnetic coil 18 is advantageously effected via contact pins 22, only one of which is shown, which are embedded in an insulating insert 23, such as glass, for example. The insulating insert 23 may be surrounded by a fastening ring 24 which is sealingly inserted into an open bore 25 of the valve housing bottom 2 and fixed in place by soldering, for example. Either plug connections or electric cables may be connected with the contact pins 22 in a manner which is known but not illustrated here. In order to compensate for changes in length in the case of heat expansion, a contact lug 26 is provided between the magnetic coil 18 and each of the contact pins 22.

A flat armature 29 is disposed between the end face 28 of the shell core 7 which is remote from the crosspiece 16 and the guide diaphragm 11. Medially of the flat armature 19, a movable valve element 30 is connected with the flat armature, by welding or soldering, for instance. The valve element 30 passes through a central guide opening 31 in the guide diaphragm 11 and cooperates with a fixed valve seat 32 provided in a valve seat body 33. The valve seat body 33 is inserted into the nozzle carrier 12. The valve element 30 projects through the central guide opening 31 of the guide diaphragm 11 in the radial direction up to the valve seat 32, while the flat armature 29 extends to the end face 28 of the shell core 7. A rigid connection of the guide diaphragm 11 is not provided, either with the valve element 30 or with the flat armature 29. The flat armature 29 may comprise a stamped or pressed part and may have, by way of example, an annular guide crown 34 oriented toward the guide diaphragm 11. This guide crown 34 has several functions: first, it improves the rigidity of the flat armature 29; secondly, it separates a first work area 36 of the flat armature, which is oriented toward the end face of the outer core 15, from a second work area 37, which is oriented toward the end face of the inner core 17; and thirdly, it forms a shoulder 35 which rests on the guide diaphragm 11, as a result of which the flat armature 29 is actuated in a parallel plane to the end face 28 of the shell core 7. The valve element 30 has a spherical portion 38 cooperating with the valve seat 32, which may be flattened out in the form of a spherical zone. The clamping of the guide diaphragm 11 between the spacer ring 10 and the nozzle carrier 12 is effected in a plane which, when the valve element 30 rests on the valve seat 32, extends through the center point M or as close as possible to the center point M of the spherical portion 38. When the valve element 30 is resting on the valve seat 32, the guide diaphragm 11 is under stress, fully drawn up, against the shoulder 35 of the flat armature 29. The valve element 30 is urged in the closing direction of the valve by a compression spring 39, which at its opposite end protrudes into an inner bore 40 of the shell core 7 and is supported on a slide member 41. The force of the compression spring 39 upon the flat armature 29 and the valve element 30 may be influenced by means of axially displacing the slide member 41.

The slide member 41 is seated at its extremity remote from the flat armature into the guide bore 4 of the base 2 and the guide fitting 3. In the area of the guide fitting 3, the slide member 41 has a portion having notches 43, such as flat annular grooves, threads, knurls or the like, in order to assure a more positive axial fixation of the slide member 41. In assembly, the guide fitting 3 is pressed inward in the area of the notches 43 such that part of the material comprising the guide fitting 3 presses into the notches 43 of the slide member 41. The end of the slide member 41 remote from the flat armature 29 terminates inside the guide fitting 3 and is provided with a tang 44 having a smaller diameter than that of the guide bore 4. A suitable tool may be used to engage the tang 44 in order to effect the displacement of the slide member 41. The slide member 41 is provided with a longitudinal bore 45 opening toward the flat armature 29; this bore 45 discharges outside the shell core 7, via transverse bores 46 leading to the circumference of the slide member 41, into the interior 5 of the valve housing 1.

The valve element 30 has a cylindrical portion 48 connected with the flat armature 29, which is adjoined by the spherical portion 38 of the valve element. The valve element 30 is open in the direction of the flat armature 29, being provided with a concentric blind bore 49, which extends as far as possible into the spherical portion 38. The compression spring 39, which at one end rests on the slide member 41, passes through an opening 50 in the flat armature and is supported at the other end in the valve element 30 on the bottom 51 of the blind bore 49. As a result, when the magnetic element 7, 18, 29 is not excited, the valve element is held in a sealing manner on the valve seat 32, counter to the spring force of the guide diaphragm 11. Transverse bores 52 are provided in the cylindrical portion 48 of the valve element 30 extending from the circumference of the valve element 30 to the blind bore 49.

A collector chamber 54 is provided downstream of the valve seat 32; its volume is intended to be as small as possible, and it is defined by the valve seat body 33, the spherical portion 38 and a swirl body 55 disposed downstream of the valve seat body 33. A crimped area 56 of the nozzle body 12 surrounds and engages a surface of the swirl body 55 which is remote from the valve seat body 33; as a result, the valve seat body 33 and the swirl body 55 are positionally fixed. The swirl body 55 has a protrusion 57 protruding into the collector chamber 54, its end face being flattened toward the valve element 30. Branching off from a lateral circumferential wall 58 of the protrusion 57 and extending conically by way of example, are swirl conduits 59 opening in the direction of the collector chamber 54. In a known manner, these swirl conduits 59 may be inclined at an angle relative to the valve axis and discharge into a swirl chamber 60. The swirl conduits 59 may discharge, by way of example, at a tangent into the swirl chamber 60 and serve to meter the fuel. The fuel film forming at the wall of the swirl chamber 60 tears off at the sharp end of the swirl chamber 60 which discharges into the intake tube; the fuel thus enters the air flow of the intake tube in a conical pattern, which assures good preparation of the fuel, especially in the case of low fuel pressures.

The fuel injection valve is supported in a holder 62 and may be positionally fixed, by way of example, by a claw or a cap 63 in the valve housing 1. The valve is provided with a first annular groove 64 and a second annular groove 65; the second annular groove 65 is offset in the axial direction and sealed off from the first annular groove 64. A fuel inlet line 66 is provided in the holder 62, discharging into the first annular groove 64. A fuel return flow line 67 is also provided in the holder 62, communicating with the second annular groove 65. Radial inlet openings 68 in the wall of the cylindrical, tubular portion of the valve housing 1 connect the first annular groove 64 with a flow conduit 69, which is provided between the outer core 15 and the inner wall of the valve housing 1. The portion of the interior 5 located above the shell core 7 communicates with the second annular groove 65 via radially extending outlet openings 70 provided in the cylindrical, tubular portion of the valve housing 1 and is separated from the flow conduit 69 by means of a sealing body 71. The guide diaphragm 11 includes flowthrough openings 73, and flowthrough openings 74 may also be provided within the flat armature 29. The fuel flowing into the flow conduit 69 via the inlet openings 68 is capable of flowing to the valve seat 32 via openings 75 in the shoulder 8 and the flowthrough openings 73 in the guide diaphragm 11; from the valve seat 32, when the valve element 30 is raised from the valve seat 32, the fuel can reach the collector chamber 54 and is there metered via the swirl conduits 59. The non-metered portion of the fuel can flow via the transverse bores 52 into the blind bore 49 of the valve element 30 and from there, via the inner bore 40 to the longitudinal bore 45 of the slide member 41 and then to the transverse bores 46, into the portion of the interior 5 located above the shell core 7, meanwhile absorbing the heat being created at the magnetic element. From there, the fuel can flow via the outlet openings 70 and the second annular groove 65 into the fuel return flow line 67.

In the second exemplary embodiment of a fuel injection valve shown in FIG. 2, the elements which are the same as and function identically to those shown in FIG. 1 are given identical reference numerals. In particular, the flat armature 29 having the valve element 30 in the second embodiment is identical to that shown in FIG. 1 and is guided in the same manner by means of a guide diaphragm 11. For this reason, this area of the fuel injection valve has not been shown in the sectional view of FIG. 2. In the exemplary embodiment of a fuel injection valve shown in FIG. 2, the slide member 41 is provided with a neck 78 on its end oriented toward the flat armature 29. This neck 78 protrudes partway into the shell core 7 and is of a diameter smaller than that of the inner bore 40 of the shell core. Between the neck 78 and the inner bore 40 of the shell core 7, an annular conduit 79 is formed, by way of which the non-metered fuel is capable of flowing into the portion of the interior 5 located above the shell core 7, removing heat from the magnetic element. The compression spring 39 is supported with its end remote from the flat armature on the neck 78. The contact pins 22 in the open bore 25 of the housing bottom 2 may be sealed by means of a sealing ring 80. The contact pins 22 and the guide fitting 3 may be further sealed by a cap 81 of some insulating and elastic material such as rubber or plastic. The cap 81 includes detent elements 82 which snap into place on the guide fitting 3, the contact pins 22 protruding out of them, when the cap 81 is put in place on the fuel injection valve. The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An electromagnetically actuatable fuel injection valve for fuel injection systems of internal combustion engines, comprising a valve housing including a wall, a magnetic coil mounted on a core having a predetermined length and constructed of ferromagnetic material and a movable armature firmly connected with a valve element arranged to cooperate with a fixed valve seat with said valve element guided by means of a guide diaphragm clamped to said housing at its outer circumference, characterized in that said guide diaphragm includes a central guide opening forming an inner edge surface through which said valve element extends toward said valve seat, said guide diaphragm inner edge surface being arranged to surround said valve element in contact therewith to provide an axial guidance while preventing radial movement for said valve element, said guide diaphragm is spring tensioned on a concentric guide edge of said armature located on a side oriented toward said valve seat with said armature spaced from said guide diaphragm inner edge surface in contact with said valve element, said armature being relatively flat and oriented toward said valve seat, said guide diaphragm further arranged to guide said armature in a direction parallel to said valve seat and said core further having an end face extending radially outward of said flat armature and a compression spring for generating a closing force on said valve element.

2. A valve as defined by claim 1, characterized in that said valve element has a spherical portion which cooperates with said valve seat.

3. A valve as defined by claim 2, characterized in that said spherical portion of said valve element is embodied as a spherical zone.

4. A valve as defined by claim 2, characterized in that said guide diaphragm has a circumference which is securely clamped in a plane which extends as close as possible to the center point (M) of said spherical portion.

5. A valve as defined by claim 4, characterized in that said valve element has a cylindrical portion which merges with said spherical portion, said cylindrical portion being contiguous to said flat armature.

6. A valve as defined by claim 5, characterized in that said valve element has a concentric blind bore, which is open in the direction of said flat armature and extends into said spherical portion of said valve element.

7. A valve as defined by claim 6, characterized in that said valve element has a wall portion and transverse bores extend through said wall to said blind bore.

8. A valve as defined by claim 7, characterized in that said core comprises concentric outer and inner core elements said inner core element being connected via a crosspiece with said outer core element and said magnetic coil being seated on said inner core element, said inner core element also having an inner bore.

9. A valve as defined by claim 8, characterized in that said flat armature has a first work area which is in apposition to a zone of said outer core element and a second work area which is in apposition to a zone of said inner core element.

10. A valve as defined in claim 8, characterized in that said magnetic coil is surrounded at least partially by a carrier body, which is connected with said crosspiece.

11. A valve as defined by claim 8, characterized in that said valve housing includes inlet openings passing through said housing wall and discharge openings offset in an axial direction from said inlet openings.

12. A valve as defined by claim 11, characterized in that fuel which flows via the inlet openings into said valve housing is carried through said guide diaphragm to said valve seat, and non-metered fuel flows through said transverse bores in said valve element into said blind bore and from there, via an axial opening in said flat armature and said inner bore of said inner core element to said discharge openings while flowing over said crosspiece.

13. A valve as defined by claim 1, characterized in that said valve housing is cup-shaped and provided with a bottom portion, a slide member being press-fitted into said bottom portion and arranged to extend partway of said length of said core, and, said compression spring is disposed between a terminal portion of said slide member and said valve element.

14. A valve as defined by claim 13, characterized in that said valve element includes a blind bore and said spring is received therein.

15. A valve as defined by claim 13, characterized in that said slide member has a longitudinal bore and a circumferential apertured wall the structure being arranged so that discharging fuel travels up said bore and through said apertured wall.

16. A valve as defined by claim 14, characterized in that said slide member has a portion having a smaller diameter than a bore in said core, so that fuel can flow out of said bore and around said slide member.

17. A valve as defined by claim 15, characterized in that said slide member is pressed-fitted into a guide bore of said bottom portion, said slide member further including an upper area arranged to be securely received in said guide bore.

18. A valve as defined by claim 17, characterized in that said slide member further includes an upwardly extending tang member, said tang member being confined in a guide fitting which surrounds said bore.

19. A valve as defined by claim 17, characterized in that said bottom is further provided with open bores arranged to receive contact pins which extend to said magnetic coil and an insulative cap aarranged to encapsulate said contact pins and said guide fitting.

20. A valve as defined by claim 2, characterized in that a collector chamber enclosing the smallest possible volume is provided downstream of said valve seat, branching off from which chamber are swirl conduits inclined at an angle relative to the valve axis and arranged to discharge into a swirl chamber.

21. A valve as defined in claim 20, characterized in that a swirl body is disposed downstream of a valve seat body provided with said valve seat, said swirl body having a protrusion which extends into said collector chamber, said protrusion further having a flattened end face oriented toward said valve element and said swirl conduits arranged to branch off from a lateral circumferential conically extending wall which communicates with said collector chamber.

22. A valve as defined by claim 3, characterized in that said guide diaphragm has a circumference which is securely clamped in a plane which extends as close as possible to the center point (M) of said spherical portion.

23. A valve as defined by claim 16, characterized in that said slide member is pressed-fitted into a guide bore of said bottom portion, said slide member further including an upper area arranged to be securely received in said guide bore.

* * * * *